US005771054A

United States Patent [19]

Dudek et al.

[11] Patent Number: 5,771,054

[45] Date of Patent: Jun. 23, 1998

[54] HEATED DRUM FOR INK JET PRINTING

[75] Inventors: Lesley P. Dudek, Webster, N.Y.; Vaughan Louis Dewar, Bartlett, Tenn.; Dale R. Ims, Webster; Michael C. Ferringer, Ontario, both of N.Y.

[73] Assignee: Xerox Corporation, Stamford, Conn.

[21] Appl. No.: 452,770

[22] Filed: May 30, 1995

[51] Int. Cl.[6] ..... B41J 2/01

[52] U.S. Cl. ..... 347/102; 347/101; 346/138

[58] Field of Search ..... 347/102, 101, 347/156, 212, 35; 399/96, 304, 303, 305; 346/134, 136, 138; 342/101, 102

[56] References Cited

U.S. PATENT DOCUMENTS

| | | | |
|---|---|---|---|
| 4,259,696 | 3/1981 | Paranjpe et al. . | |
| 4,325,086 | 4/1982 | Sato et al. | 358/296 |
| 4,340,893 | 7/1982 | Ort . | |
| 4,467,366 | 8/1984 | Bobick et al. . | |
| 4,469,026 | 9/1984 | Irwin . | |
| 4,520,368 | 5/1985 | IMS . | |
| 4,566,014 | 1/1986 | Paranjpe et al. | 347/102 |
| 4,774,523 | 9/1988 | Beaufort et al. . | |
| 4,811,038 | 3/1989 | Gordon et al. | 347/102 |
| 4,914,478 | 4/1990 | Yashiki | 492/28 |
| 4,970,528 | 11/1990 | Beaufort et al. . | |
| 4,982,207 | 1/1991 | Tunmore et al. | 346/138 |
| 5,214,442 | 5/1993 | Roller . | |
| 5,227,815 | 7/1993 | Dastin et al. | 347/116 |
| 5,296,873 | 3/1994 | Russell et al. | 347/102 |
| 5,356,229 | 10/1994 | Hickman et al. | 400/642 |
| 5,517,222 | 5/1996 | Sugiyama et al. | 347/35 |

*Primary Examiner*—N. Le
*Assistant Examiner*—Thien Tran
*Attorney, Agent, or Firm*—Oliff & Berridge, PLC

[57] ABSTRACT

An ink jet printing system utilizes a heated rotary printing drum for mounting and carrying paper to be printed by one or more thermal ink jet printheads to achieve black or full color printing at high speed. As printing and drying are achieved prior to any transfer of the sheet from the drum, smudging of images is prevented. Such a printing system is capable of producing dried prints that can be immediately stacked and handled without smudging using slow-drying black inks and fast-drying color inks at speeds exceeding 10 pages per minute for color and 20 pages per minute for monochrome black text or images. Hold down of the sheet onto the drum can be achieved using vacuum or electrostatic forces to precisely retain the sheet on the drum until printing and drying are completed. Partial tone printing on multiple passes of the heated drum is provided to eliminate mottle on large solid areas. Heating of the drum can be performed internally or externally.

27 Claims, 7 Drawing Sheets

| Turn# | Activity | BlackX | ColorX |
|---|---|---|---|
| 1 | Start printing with right half of the black head. | 0 | -1.92 |
| 2 | Start printing with full black head. | 0.64 | -1.28 |
| 3 | | 1.28 | -0.64 |
| 4 | Start printing with right half of color heads. | 1.92 | 0 |
| 10 | | 5.76 | 3.84 |
| 11 | All but 0.1 inches of the right half of the black head is off the right margin. | 6.40 | 4.48 |
| 12 | All but 0.1 inches of the left half of the black head is off the right margin. | 7.04 | 5.12 |
| 13 | | 7.68 | 5.76 |
| 14 | All but 0.1 inches of the right half of the color heads are off the right margin. | 8.32 | 6.40 |
| 15 | All but 0.1 inches of the left half of the color heads are off the right margin. 15 turn cycle if <6.4 inch print zone. | 8.96 | 7.04 |
| 16 | Last turn to finish drying of the 0.1 inch color strip printed on the previous turn. Unload the sheet at the exit port. Load sheet at the entrance so that the cycle starts at the next turn. 16 turn cycle time per page if print zone is 6.4 to 7.04 inches wide. | Moving 8.96 to 0 | Moving 7.04 to -1.92 |

FIG.5

| Turn# | Activity | Start Time (sec.) | Start Time (sec.) |
|---|---|---|---|
| 1 | Print first checkerboard layer of the image. During the time the gutter passes, do the maintenance spitting. Optionally move the bar during the guttering time to provide an offset of the jets for the second pass of the checkerboard. | 0 | 0.765 |
| 2 | Print the second checkerboard layer of the image. During the time the gutter passes, do the maintenance spitting. If offset printing was done, move the bar back to the starting position. | 0.765 | 1.53 |
| 3 | Strip off the printed sheet and load the next sheet. | 1.53 | 2.30 |

FIG.6

HEATED DRUM FOR INK JET PRINTING

BACKGROUND OF THE INVENTION

1. Field of the Invention

The invention relates to a thermal ink jet multi-pass printing system that utilizes a heated drum for mounting and carrying paper a plurality of times past one or more full width thermal ink jet printbars, a single die printhead, or partial width printhead or cluster to achieve black or full color printing at high speed. Such a multi-pass printing system is capable of producing superior quality dried prints that can be immediately stacked and handled without smudging using slow-drying black inks and fast-drying color inks at speeds exceeding 10 pages per minute for color and 20 pages per minute for monochrome black text or images.

2. Description of Related Art

High edge-sharpness black printing is desirable in any printer. The typical goal is "laser-quality." Color printers typically focus on the quality of the color reproduction and have less concern for edge definition. Black ink jet printers that can yield sharp edges on plain paper are inherently slow-drying. This means that a page will still be wet and smudgeable when output unless substantial amounts of drying time and/or thermally assisted drying are provided.

When using a color printer, intercolor bleed is reduced by the use of fast-drying inks. While fast-drying inks have lower edge definition, they are acceptable for color reproduction. Ideally, a full color printer would use slow-drying ink for monochrome black text and graphics and fast-drying color inks for color reproduction. However, the slow drying of the black ink causes intercolor bleed when used with color inks in normal printing or requires substantial drying time. Also, heated platen drying of slow-drying black ink tends to degrade the black image quality, causing mottled images, when printed in a normal mode.

Prior ink jet devices having printing drums are known, but these were limited in speed by post-printing drying or did not produce high quality images because of the lack of proper drying prior to output. Most printers utilize one of two methods of image fixing (drying), either naturally air drying the image or routing the image to a heating unit for drying of the image. Common problems with air drying are an excess of drying time and smudged images when the printed "wet" images are handled and transported prior to sufficient drying. Subsequent heating also has problems. Most dryers are designed to meet a worst case print job (very high print coverage). This requires either a very large power source for high temperature heating or long drying times. While some adaptive dryers are known that compensate for print coverage or other constraints, these still do not provide the most efficient throughput while maintaining sufficient drying.

Special printing processes have been developed to achieve better edge definition and reduce intercolor bleed with color inks in a reciprocating printhead printer. However, until now, there have been no printing devices or methods capable of achieving high quality, high speed thermal ink jet printing (exceeding 10 ppm for color or 20 ppm for black).

OBJECTS AND SUMMARY OF THE INVENTION

It is an object of the invention to provide a thermal ink jet printer that is capable of high quality, high speed operation with reduced intercolor bleed.

It is another object of the invention to utilize the time necessary for completion of the printing to perform drying, thereby making use of already allocated cycle time to increase throughput by eliminating or reducing the extra time necessary to complete drying.

It is another object of the invention to eliminate mottle caused by use of a heated printing surface.

The above and other objects are achieved by a thermal ink jet printer and method having a heated, rotatable drum for holding, transporting and heating printing media such as plain paper, labels or transparencies.

The heated drum is capable of automatically securing sheet-fed paper tightly to the surface of the drum through vacuum or electrostatic forces. This drum is also sized to accept normal letter stock, as well as legal size and European sizes such as A4.

The printer receives and stores electronic data for printing and can discriminate between black and color images. The printer passes data to one or more printheads, preferably in partial tone form, for production of high-quality images. The printer may utilize a single die printhead, a Partial Width Array (PWA) consisting of two or more die butted together to form a single printing element that is wider than a single die, a PWA cluster which is a group of PWAs mounted into an aligned printing unit, or a Full Width Array (FWA).

The invention can also be practiced using either one or more monochrome printheads or color printheads. FWA color printbars provide increased color throughput, but at additional cost for the plurality of FWA printbars, one for each color. PWA color printing can be achieved for less cost, but at a reduced throughput. A special printing process allows high speed printing and drying, while the heated drum assembly permits multiple printing passes with precise registration and thermally assisted drying.

The heating of the drum can be accomplished by several methods, which include, but are not limited to, inside-surface contact heaters, internal radiant heaters and external radiant heaters or hot air blowers. This heating is performed during printing, but can also be performed before (pre-heat) and after (post-heat) printing depending on the application and need.

The printer may include automatic feeding of sheets to the rotating heated drum, presenting the sheets in a manner consistent with automatic mounting of the sheet onto the drum. The printer may also include automatic withdrawal of printed sheets from the drum for outfeed to an output tray, de-curler, inverter or other post-printing location.

Preferably, multiple revolutions of the drum are used for printing of at least the black ink (in partial tone) to enhance image quality and eliminate mottle. This is especially important when printing with slow-drying ink formulations. If sufficient drying is not achieved during this printing time by the heated drum, one or more subsequent non-printing revolutions are provided to properly dry the ink on the printing sheets prior to output to prevent smudging.

The printhead cluster or Partial Width Array (PWA) Cluster can consist of four printheads with a printing capacity of approximately 1.28" wide. These printheads are made up of one black and three color printing die that are closely registered to one another along with other printing components such as manifolds and substrates. A carriage incrementally moves a cradle, containing the printhead cluster, laterally across the drum during interdocument spacing between revolutions. Each incremental movement can be 0.64", one half of the PWA width, to enable partial tone printing. Printing of an entire one of the printing sheets is accomplished by printing during several rotations around the drum. Black only printing can be performed at up to 25 copies per minute (using the FWA) while color is capable of about 5 pages per minute using the PWA printheads.

The drum, being heated, dries the ink (especially the black ink) as soon as possible to minimize intercolor bleed. Printing black ink in large solids on a heated paper substrate often results in a mottled image. However, this can be eliminated by not printing large solid areas in a single pass, i.e., through partial tone printing on multiple passes, thereby letting the ink dry somewhat prior to making the full image. Partial tone printing, especially checkerboarding, also minimizes printhead signature defects and reduces paper curl.

This combination of multiple pass printing using a rotating drum with heated drying produces prints having high definition black edges and low intercolor bleed. Moreover, printing rates exceeding 20 ppm for black and 10 ppm for color prints can be achieved.

BRIEF DESCRIPTION OF THE DRAWINGS

The invention will be described in detail with reference to the following drawings wherein:

FIG. 5 is a chart of the printing and drying sequence for a full color image according to the invention;

FIG. 6 is a chart of the printing and drying sequence for a monochrome image according to the invention;

DETAILED DESCRIPTION OF PREFERRED EMBODIMENTS

Figure 1:
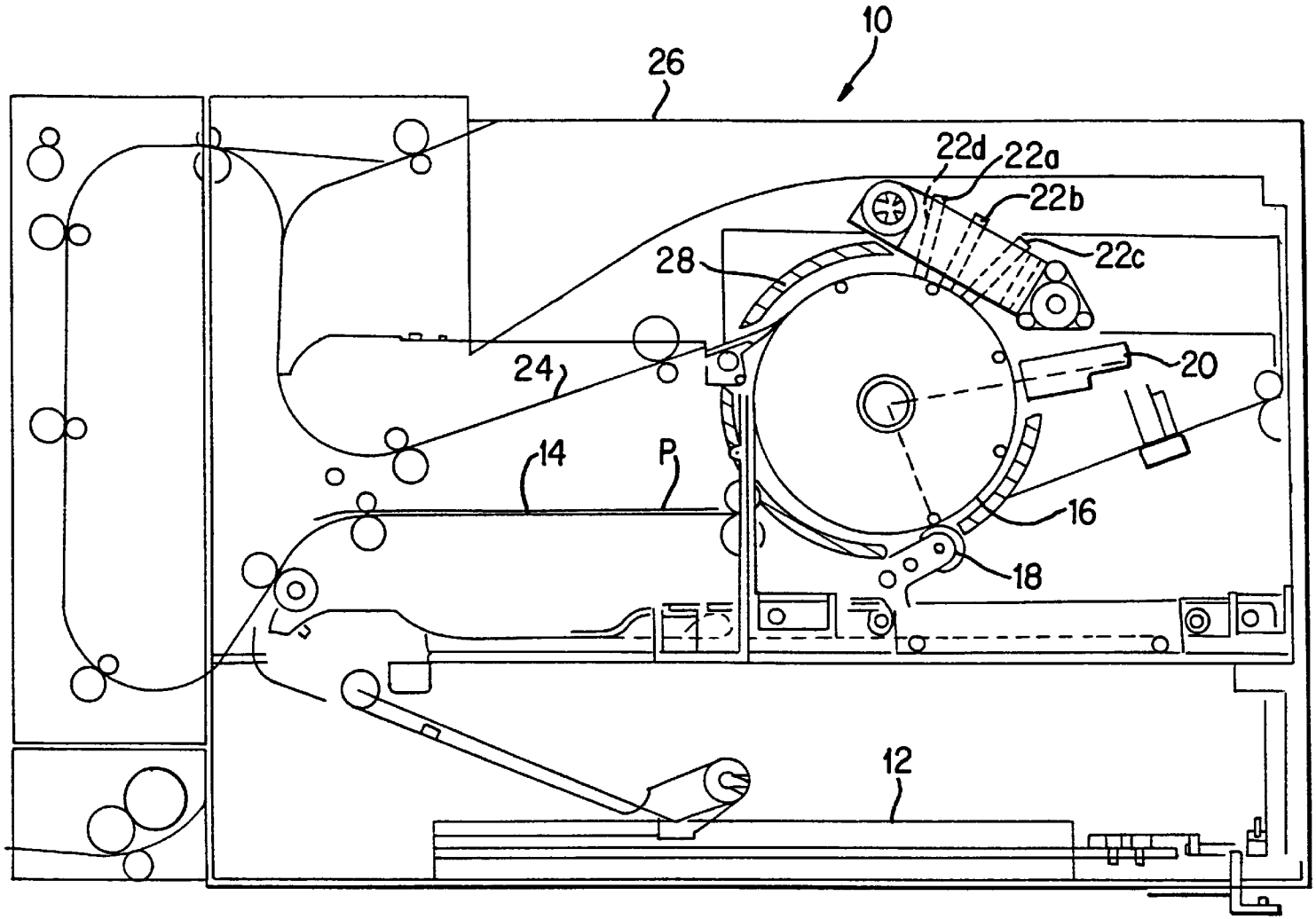
FIG. 1 is a cutaway view of a thermal ink jet printer according to the invention.

With reference to FIG. 1, a preferred printing system 10 includes an input sheet tray 12, an input sheet path 14, a heated rotary transport drum 16, a sheet hold down means 18, a Full Width Array (FWA) black printbar 20, a color Partial Width Array (PWA) printhead cluster 22 consisting of radially spaced Cyan, Yellow, Magenta and Black printheads (22*a–d*) located on a translatable carriage, an exit sheet path 24, a sheet output tray 26 and insulating walls 28. Both the printbar 20 and printhead cluster 22 can be tilted away from drum 16 to allow automatic or manual maintenance, repair or adjustment.

The FWA printbar 20 is used to print black-only documents and the PWA printhead cluster 22 is used to produce colored documents. The black PWA printhead 22D is laterally offset from printhead 22*a*. Alternatively, the colored PWA cluster 22 can be replaced with radially spaced FWA printbars.

The colored FWA array will provide substantially increased throughputs for color printing, but also acquires a substantial extra cost for the FWA arrays. If monochrome printing at moderate speed and low cost is desired, the FWA printbar 20 and PWA cluster 22 can be replaced with a single printhead die or PWA array.

The printer 10 uses electrostatics or vacuum to capture a sheet on the drum 16—short edge feed—and uses the drum 16 as both a transport mechanism to transport the sheet past the printheads 20 and 22 multiple times and simultaneously serving as a dryer for heating the sheet and drying the ink as it is printed prior to output. The preferred parameters of the configuration are shown in the following table.

TABLE 1

| Parameter | Value | Unit |
|---|---|---|
| Drum Circumference | 15.3 | inches |
| Drum Surface Speed | 20.0 | inches/second |
| Print Head Width | 1.28 | inches |
| Print Bar Width | 8.32 | inches |
| Longest Paper | 14.0 | inches |

Figure 2:
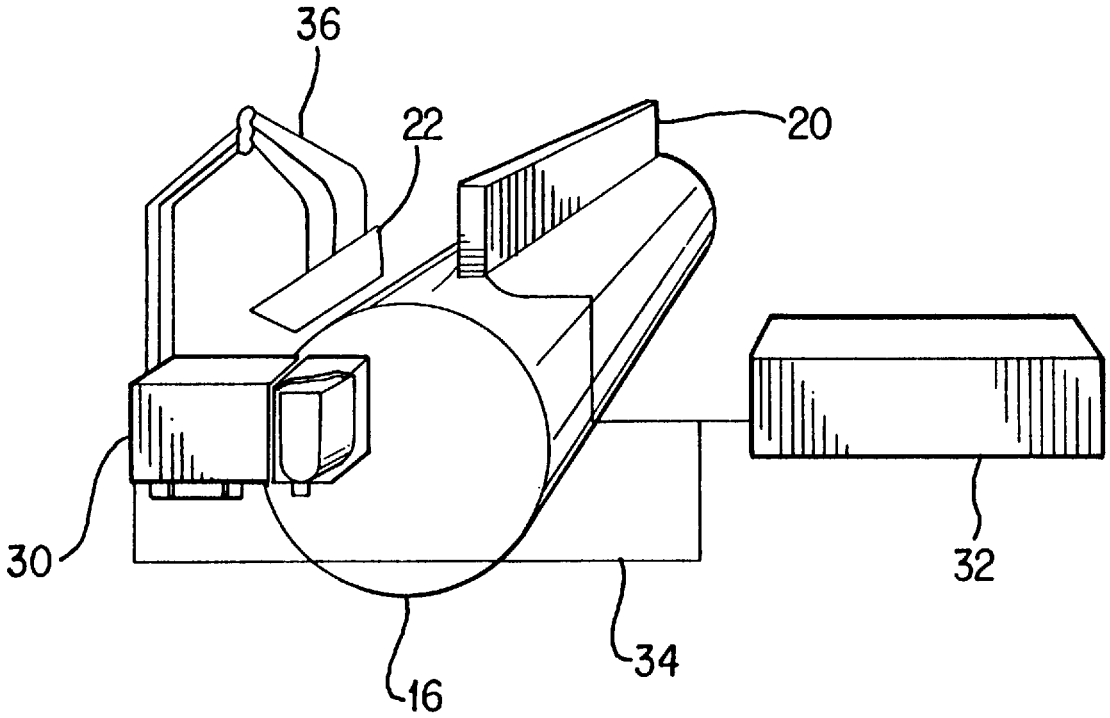
FIG. 2 is a schematic isometric view of the ink handling system according to the invention.

FIG. 2 shows the preferred ink supply arrangement for the printer. Color ink reservoirs 30 are provided, one for each color printhead 22 (CYM). These are connected to the respective printheads 22 through flexible supply lines 36. A black ink reservoir 32 can supply both black printbar 20 and the black printhead of PWA cluster 22 through split supply line 34. Although use of the black FWA printbar 20 for monochrome printing and use of the black PWA printhead for color images is preferred, it is contemplated that the black printbar 20 could be used for both monochrome and black color images (saving the expense of the black printhead in PWA cluster 22). Alternatively, separate ink reservoirs can be provided for each of the black printbar 20 and black printhead 22. In this case, each could be provided with a differing ink composition, allowing, for example, fast-drying black ink to be supplied to black printhead 22 (to reduce intercolor bleed in color prints) and slow-drying black ink to be supplied to black printbar 20 (for better picture quality in monochrome prints).

Figure 9:
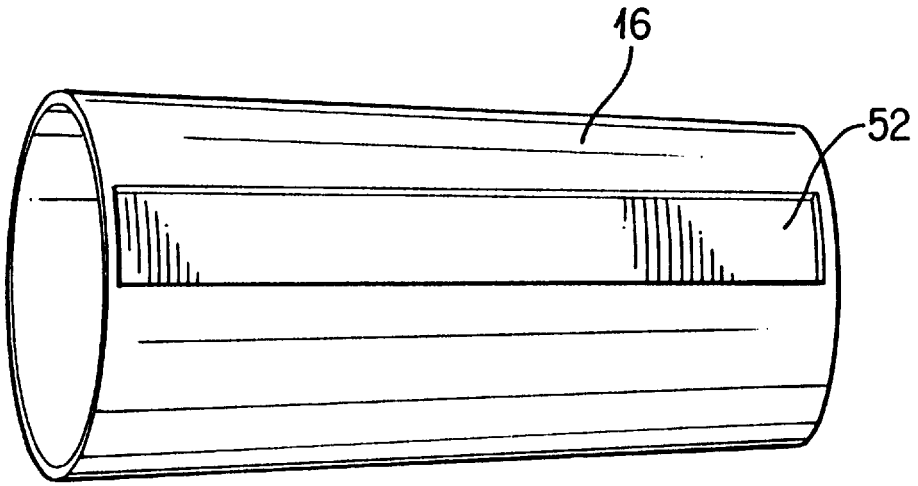
FIG. 9 is a view of the heated drum and gutter according to the invention.

To simplify control and provide stability, only one speed is used for drum 16. A sheet P is loaded and unloaded at full speed. The rotation speed of the heated drum 16 is set to a maximum determined by the firing logic (number of jets and number fired at a time) and the maximum jet firing rate. Actually, the limit is on the surface speed of the drum when combined with the resolution of the printhead. The rotation speed is then derived trivially using the drum diameter. The drum diameter has been nominally selected to provide for guttering, used in maintenance operations on the printheads (better shown in FIG. 9), and transition space to the edges of the largest sheet contemplated. The preferred diameter provides a 15.3 inch circumference, allowing 8½"×11", 8½"×14" and A4 sizes to be fed. However, the drum diameter can be modified to match a specific encoder and drum drive gear configuration to the desired pixel spacing or to accept larger sheet sizes. Using this drum, the drum speed is preferably 20"/sec. at the drum surface. The drum 16 is not slowed or sped up for any function. An exception would be to reduce throughput if the drying from the heated drum cannot keep up. However, there are problems with the control and timing of adjusted drum speed and the better solution is to add extra turns of drum 16.

The carriage motion and printhead sizes strictly delimit the throughput of the printer in ways that are more complex than drying. Thus, when printing full color documents using the incrementing PWA printhead cluster 22, most often the printing will take longer than the drying requirements. In cases where the drying from heated drum 16 cannot keep up, then extra turns on drum 16 could be added to slow the process.

Additionally, for reasons relating to drying that will be more fully described in detail later, the heated rotary drum is able to pre-heat the sheet slightly as the sheet is acquired and advanced, at a constant speed, toward FWA printbar 20 and PWA array 22. Additionally, during certain conditions, such as during high humidity, a revolution of the drum with the acquired sheet may be performed prior to printing to further preheat the sheet and remove water from the paper.

A first example of monochrome printing using the FWA printbar will now be described with reference to FIG. 1. The full width black printbar 20 is used to print, in high speed, the black only pages. The printing preferably is performed in two or more rotations of drum 16 with a partial tone of the pixels printed in each pass. Most preferably, two printing passes are provided and one half of the pixels are printed in each pass (checkerboard). Use of the checkerboarding reduces mottle, especially where the ink is slow-drying and printed on a heated support (drum 16). A third pass (rotation) is used to finish the drying before stripping the page off to an output de-curler, if necessary, and to a sheet output tray.

Assuming the three turn cycle for FWA printing, the dry time for the first ink printed is 1.53 seconds plus a fraction of 0.765 seconds for the last turn. This fraction is about 0.5 to 0.38 seconds. Thus, some ink drys for 1.9 seconds. The least dried ink has 0.765 seconds plus about 0.38 seconds–1.14 seconds. Thus, the heating of drum 16 must be sufficient to heat this last applied ink within approximately 1.14 seconds.

The black only throughput is determined by the need to move the sheet and dry it with the dryer at a nominal temperature. For the black only printing, the three turns of the drum are used according to FIG. 6. At the rated speed of 20 inches per second for the paper, the three turns produce 26.1 pages per minute. These are true, full page documents. There are two ways to reduce the throughput for dryer loading purposes if the dryer cannot complete drying according to this schedule. One way is to insert extra turns of the drum into each one of or selected printing page cycles. The fall back throughputs then become: 19.6, 15.7, 13.0, or 11.2 pages per minute as 1, 2, 3, or 4 turns are added. The other way to increase drying time is by slowing down the speed of the drum. This could continuously stretch out the printing times. However, the tilt of the printbar is based on a fixed sheet feeding speed and only small adjustments are contemplated with drum slow down. Additionally, this slow down would greatly affect the process control requirements of the system, requiring more complicated hardware or software for controlling timing and other functions.

The same throughputs would hold true if four radially spaced FWA printbars were used for color printing, rather than PWA cluster 22. Thus, color printing at greater than 20 ppm is also possible, if all colors were printed on the same pass (either partial tone or not). Alternatively, to improve picture quality, each color could be printed on a separate pass or multiple passes (partial tone). This would reduce throughput, but improve picture quality.

Additional constraints on the throughput of the printer when using the FWA printbar 20 is the requirement of the heating components on the available power that the printer is allocated. It is contemplated that in the exemplary printer 10, the power constraints of the heater components should be limited to 800 watts. This value was selected to allow sufficient power remaining to control the other functions of the printer. Of course, the amount of power allocated is dependent on the particular printer used, the priorities given the power requirements of each component of the system, and economic impact on both initial cost and operating cost. Accordingly, a compromise needs to be made between power requirements and throughput when printing in monochrome (because of the short print times).

Several constraints control the drying time necessary. These constraints include, but are not limited to, the area coverage of the printed ink, the characteristics of the particular inks used, humidity, paper material and thickness, and the like. At least when text is concerned (as opposed to graphics), area coverage is nominal. Thus, typical pages should be dried within the preferred three turns of the drum. However, in the instances where area coverage is large such as with graphic images, or high humidity, sensors can detect these conditions and add additional turns, thus only decreasing throughput in limited situations. The specific determination of drying constraints and drying time necessary will be described later in more detail.

When printing in full color using the PWA cluster 22, there are less concerns with drying requirements, due to the extra number of turns required for the carriage to print (thus inherently providing more drying time for most of the image). The PWA carriage containing four color printheads 22 is used to print the color pages. Preferred printheads are each 1.28 inches long consisting of two die of 384 jets each. The black head prints in its own pass which is one-half head width ahead of the colors which are all printing on the same pass (and radially spaced). The carriage is preferably stationary during the printing, and increments laterally (one half head width) aggressively during the non-printing part of the rotation. Using this system, it takes fifteen turns of drum 16 to print a 8½" wide page with 1" margins (6.4 inch print width). The printing mode is preferably checkerboard, or other forms of partial tone printing, for all of the printheads 22. If, however, checkerboard printing is not desired, the number of turns could be decreased, thus nearly doubling output as a side benefit.

A preferred printing method for a color image is shown in FIG. 5. Assuming a fifteen cycle printing operation using the PWA cluster 22, the dry times vary across the page. The second pass colors (checkerboard) on the far right of the printed area have one full turn and part of another turn to dry. This is 0.765 seconds plus a fraction (about 0.3 of a turn or 0.23 seconds) for a total of about one second at the preferred drum surface velocity of 20"/sec. The first pass pixels have 14 full turns plus a fraction (0.23 seconds). This is approximately 11 seconds. Unlike FWA bar printing (with only three turns), there is very uneven drying. However, this should not produce visible differences.

A more detailed description of the preferred PWA printing cycle will now be described with reference to FIG. 5. The first turn of the heated drum 16 starts when the lead edge of the sheet is at the first printhead (PWA 22*d*). The carriage location (laterally across a print zone of the sheet) is zero when the center of the black head is at the left edge of the print zone. In FIG. 5, the starting point assumes that the carriage has reached the zero point (ready to print) and the lead edge of the sheet has reached the print zone. As shown, at this time, the color heads are offset laterally by −1.98 inches.

As shown, the printheads print in 0.64" strips. After the first turn of heated drum 16, black is printed on specified locations on this 0.64" strip based on a desired image and starts drying. On a second turn of drum 16, the carriage is advanced by 0.64" so that a second black strip is printed. The location of the color printhead during the second turn is −1.28" from the print zone (0). Accordingly, color is not printed yet. During the third turn of drum 16, the carriage is advanced another 0.64" and a third strip of black is printed. As of yet, no overlapping colors have been presented.

On the fourth turn, the carriage is advanced another 0.64". This time, the color printhead is finally at the 0 position and starts color printing. This prints color over the first black strip printed during turn 1. Thus, three full revolutions of drying take place before another color is printed over the previously printed color (black). This incremental printing process continues through turn 16 as shown.

Without loss of throughput, the margins could be widened to 7.04 inches. This is because there are turns where only 0.1 inches of either the left or right half heads are being used. If a 6.4 inch page width is close enough to the typical 6.5 inch print zone found on many printers, then 15 turns of the drum are enough. If the printed page width is 6.5 to 7.04 inches, one extra turn of drum 16 is needed (16 turns). The throughput would necessarily drop down to 4.9 ppm for full color printing.

Drum 16 is turning with a surface speed of 20 inches/second with a circumference of 15.3 inches. This gives a time per rotation of 0.765 seconds. The time for 15 turns is then 11.48 seconds. This results in the ability to print 5.23 pages per minute using full color printing. The time available to recover the carriage containing printheads 22 to the start of the next page is one turn (number 15) plus the balance of turn 14 from the last printhead leaving the bottom margin until the first printhead hits the top margin. If the margins are one inch and the circumferential distance from the first to last printhead is 1.5 inches, then the partial turn provides a distance of 4.8 inches. The sum of the time from part of the 14th turn and the full 15th turn is 1.01 seconds. This 1.01 seconds is the time available for the carriage containing printhead cluster 22 to move 8.96 inches laterally, including any time to compensate for hysteresis (this time is also available for drying the ink deposited on the previous turns).

It is applicants' experience that slow-drying black ink is the most improved by the checkerboard printing mode. Thus, it is possible to print the black using the checkerboarding and the other colors (CYM) in single pass to improve throughput while still reducing problems with the black reproduction.

Alternatively, the black FWA 20 could print the black portion of the full color image on the first or first and second turns (checkerboard), and the remaining turns could be used to print color using CYM printheads 22. Besides an increase in throughput, the black ink, which requires the most drying time, in this example would inherently attain the greatest amount of drying time. Because the preferred PWA print cycle does not provide color printing until the fourth turn, this alternative embodiment would not only provide more drying time for the black ink, but also improve throughput slightly.

A preferred monochrome printing and drying sequence will be described with reference to FIG. 6. During a first turn of the heated drum, a first checkerboard layer of the image is printed. Also during this turn, maintenance of the printhead, such as guttering, can be achieved. In a second turn, a second checkerboard layer of the image is printed to complete the image. This second checkerboard layer does not overlay the first checkerboard layer so that drying of the first layer can occur. A third turn of drum 16 strips of the sheet and loads a next one.

Figure 3B:
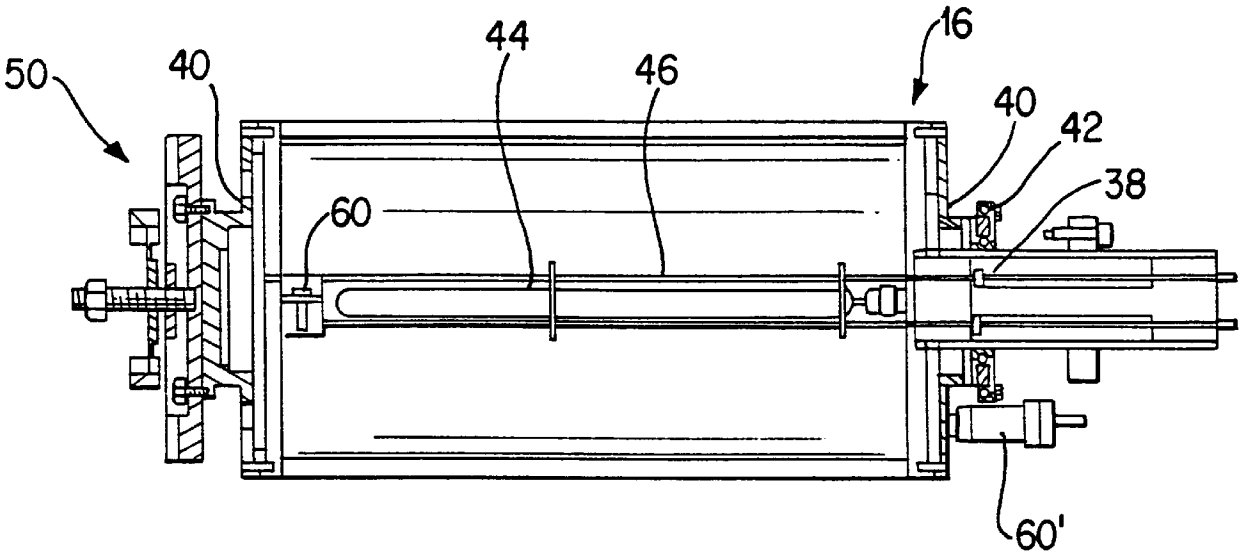
FIGS. 3A and 3B are cross-sectional views of the heated drum according to the invention.
Figure 3A:
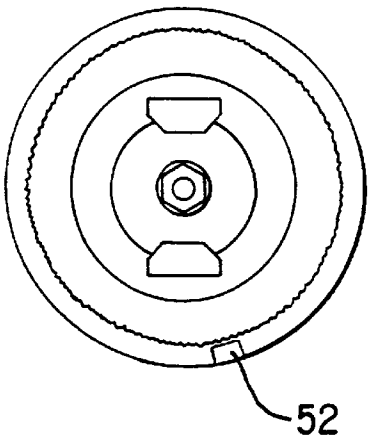
Figure 4:
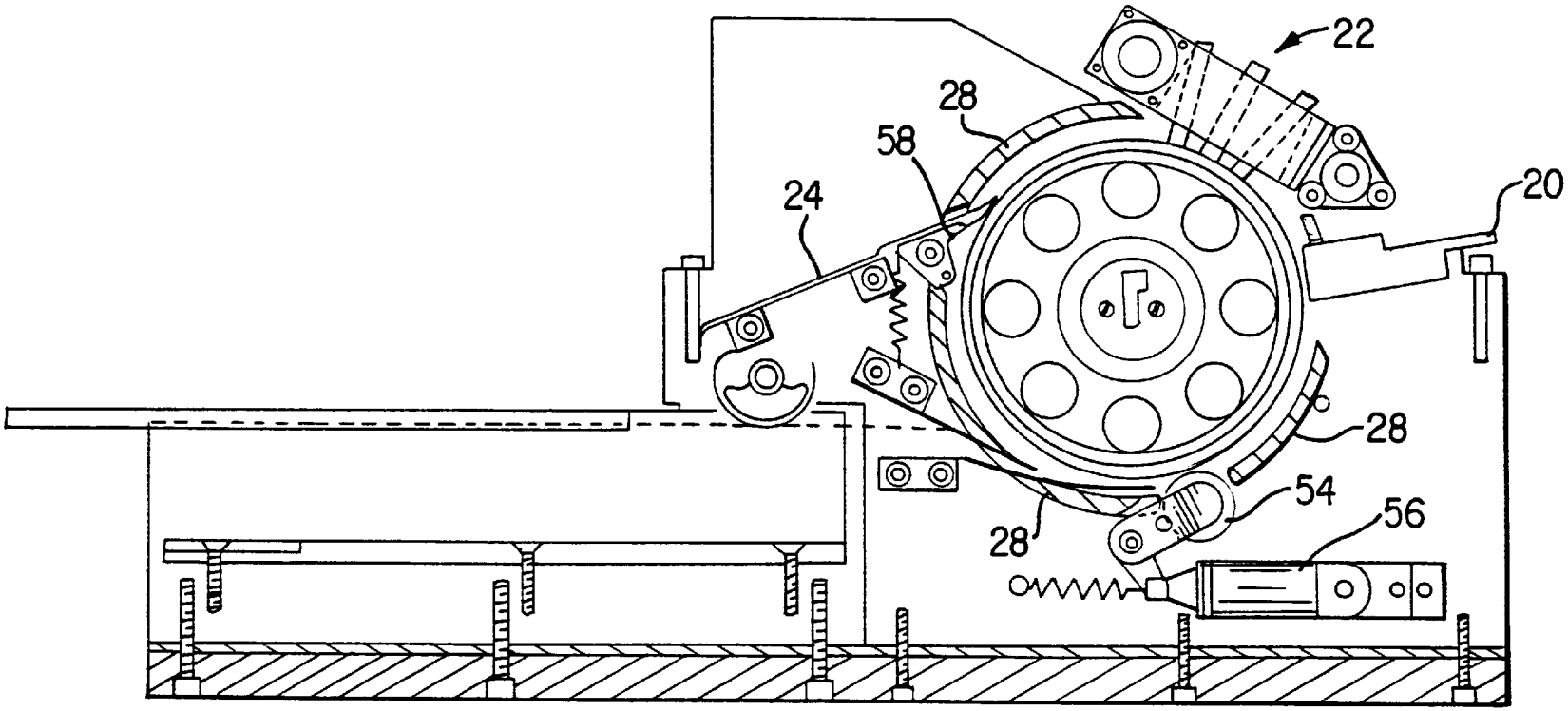
FIG. 4 is a cutaway side view of the heated drum and surrounding structure according to the invention.

The heated drum 16, applicable to both FWA and PWA printing embodiments, is designed to accommodate several constraints and is better shown in FIGS. 3–4. The drum is equipped to precisely register and hold-down the sheet on the perimeter of the drum and transport the held sheet past one or more printheads 20 or 22. Preferably, this registration and hold-down is achieved through vacuum or electrostatic forces applied to the drum and the sheet to be held. If vacuum attraction is used, vacuum hold-down and timing can be achieved as disclosed in U.S. Pat. No. 4,469,026 to Irwin, the disclosure of which is incorporated herein. Electrostatic hold down is preferred and will be discussed later in more detail.

Proper registration is achieved by timing of the sheet reaching the drum and activation of the charge (electrostatic) or vacuum (vacuum hold-down). Once the sheet is acquired, it maintains the same registered alignment on all subsequent passes until detached from the drum. The sheet may be detached using stripping fingers 58 known in the art that are activated as the lead edge of the sheet approaches a take-off point on the drum. Because the sheet tends to assume a curled state after being on the drum, a de-curler is preferable and can be located downstream from the stripping fingers. The decurler flattens the sheet allowing the flat sheet to continue to an output sheet path or a sheet output tray.

Another aspect of the drum design is heat storage. Most heater control systems will not be able to adjust to rapidly changing heat needs, unless a heat source such as microwave energy is utilized externally on the surface. Thus, the drum 16 will typically serve as a heat store. If the storage capacity is too large, the warm up time will be too long. If the storage capacity is too small, incomplete drying will occur either in a print or in a stream of prints after heat is incrementally removed faster than it can be replaced. Additionally, a large heat storage comes with a high mass and a large moment of inertia for the drive system to handle. It is assumed that a drive motor (not shown) will be decoupled via a belt and will not have a problem starting the drum to turn. Furthermore, the drum 16 will preferably be running at a constant speed (or a couple of speeds which are dependent on the print mode).

Internal heating of the drum is preferred. Thus, the drum is directly in the heat path from a heating element to the sheet. This requires the drum to be highly conductive thermally and to have a high diffusivity, allowing rapid equilibration of temperatures on the surface. Furthermore, the cost of fabrication should be low. An easy choice is extruded aluminum. By making as many features as possible axial in nature, the costs can be contained by capturing the features in a custom extrusion die. The light weight, strength and machinability of the material (aluminum) are other important assets.

A cross-section of the preferred drum 16 has a moderately thick-walled cylinder (0.250 in. wall thickness, 0.002–0.005 mil coating thickness) with a thin electrically resistive coating on its surface. The electrically resistive layer is used when electrostatic hold down force is provided. A recessed axial stripe along the drum's length is provided as a gutter 52 (better shown in FIG. 9) to enable the printbar 20 and print heads 22 to periodically fire droplets so as to prevent latency problems. This guttering can be performed between printing operations such as those described with reference to FIG. 6.

The electrical insulator (coating) must be placed between the sheet P and the drum surface to prevent the electrostatic charge placed on the sheet from draining off when electrostatic forces are used. There are some rather severe requirements for the coating material. It must have a high electrical resistivity so that the charge cannot leak through from the sheet to the grounded drum and it needs to have that high resistivity at the operating temperature of the drum. The material must also transmit the heat from the drum below to the sheet above so that the material's thermal conductivity should be high. Further, the material requires good mechanical properties at the operating temperature, and the breakdown voltage must be high enough to prevent breakdown with the voltages used.

This combination of requirements eliminates most materials. The intended operating temperature of the drum is above the use temperature limit for Mylar (PET). It is apparently difficult to grow an anodic oxide with the required breakdown strength. GE's Ultem (polyetherimide) is a potential candidate due to its high use temperature limit and its high thermal conductivity. However, the preferred material is Kapton (polyimide). This material appears to have the necessary mechanical, thermal and electrical properties. The ability to apply the coatings from solution would be an advantage.

It is desirable to keep the insulating layer as thin as possible in order to minimize the thermal resistance of the coating. In addition, a thin layer helps to minimize the voltages that result from the charge densities required to give the needed electrostatic pressures. Preferred coating thicknesses are on the order of 1–2 mils.

If electrostatic hold-down force is used, the electrostatic hold-down pressure, holding the sheet P to the drum 16, is proportional to the square of the electric field applied. The electric field that one can apply to the sheet/coating/drum structure is limited by Paschen breakdown of the air gaps. The Paschen limit is a function of gap length, and in the gap length range of 5 to 100 $\mu$m, is described by:

$$E_p=6.2+312/d$$

where $E_p$ is the breakdown field in volts/$\mu$m and d is the gap in $\mu$m. Smaller gaps have higher breakdown fields, so to maximize the holding force (pressure) it is preferred to apply the charge while the sheet is in contact with the insulating coating. The limiting value of the field is set by the mean air gap thickness between the sheet and the coating. Typical paper sheets have mean air gap thicknesses of 8–10 $\mu$m, so the maximum field which can be applied is of the order of 37 volts/$\mu$m. This field should give a pressure of the order of 24 inches of water, so high holding forces are possible.

In order to provide a field of 37 volts/$\mu$m, a charge density of about 327 pCoul/$m^2$ needs to be applied. At a process speed of 20"/sec and a sheet width of 8.5", the charging current required to provide that charge density is about 36 $\mu$amp. The resulting voltage, assuming a 2 mil Kapton layer and a paper sheet with a 10 $\mu$m mean air gap, is about 900 volts. A 4 mil thick transparency might result in a voltage of 1600–1800 volts being required for the same field. Thus, a suitable charge applicator must be able to generate these amperages at these intended voltages.

The device 54 used to apply the charge to the sheet needs to do so while the sheet is held against the coating/drum so that breakdown is avoided as the sheet moves toward contact due to the application of charge. A conductive charging roll is ideal, but a relatively stiff charging brush or a corotron with a presser foot will also suffice. These are readily available and known in the art. A charging roll appears to offer more accurate positioning of the sheet on the drum since there is less friction on the sheet during the critical lead edge acquisition.

It is desirable to have a relatively soft charging roll so that it can make contact over its full length without too much pressure loading. A Shore-A durometer of 50 or less is preferred. The value of the charging roll's resistivity is apparently not too critical, but should be on the order of $\leqq 1\times10^5$ Ohm-cm.

In addition to the hardness and resistivity requirements, the charging roll needs to be able to stand up to the temperature of the drum and perhaps occasional exposure to ink or ink residue. A preferred charging roll is made from carbon-loaded silicone and has a Shore-A hardness of about 30. Typical charging rolls of BTR's are made of Urethanes, EPDM or nitrile rubber with appropriate additives. While these can be substituted, they are only marginally adequate for the contemplated temperatures of the preferred drum.

An actuator 56 is provided to move the charging device into contact with the coating/drum just prior to the arrival of the lead edge of the sheet. Thus, charging of the coating begins only before the sheet reaches the charging device 54. A solenoid is used to provide the actuation, although other comparable actuators can be substituted.

The charging device 54 is held in contact with the sheet and coating/drum until the trail edge of the sheet has been charged. At that point, the actuator 56 retracts the charging device so that it does not contact wet ink, which may be present on the sheet as the sheet rotates past the charging roll on its second and subsequent revolutions.

It is difficult to hold the ends of the sheet down tightly to the surface of the coating on the drum because the sheet's beam strength wants to prevent the sheet from being bent. Further, it is the bending moment in the sheet at each location which determines the radius of curvature of the sheet (at least if it is not tight to the drum), and the bending moment goes to zero at the very end of the sheet. Thus, the very ends of the sheets are difficult to hold tightly to the drum.

If the sheet's beam strength causes the ends of the sheet to peel away from the coating on the drum after charging device 54 has applied the charge, the field may exceed the Paschen limit, and the air gap will break down. Charge that leaves the sheet is no longer acting to hold the sheet to drum 16, and the gap may widen as the field decreases. This process iteratively deteriorates the electrostatic force until the sheet peels off the drum.

A second cause of charge loss from the critical end regions of the sheets if they begin to lift is lateral conduction in the sheet. As the gap widens, the potential on the sheet increases even if Paschen breakdown occurs, and charge will move from the high potential regions (those with the largest gap) to those with the smallest.

A couple factors do, however, help or increase the holding tendency. As the sheet heats up, it begins to accept the shape it has been bent into. Thus, the force tending to peel the sheet from the drum/coating decreases. Also, pre-curling of the sheet is effective in reducing the paper's effective beam strength. It has been demonstrated that 20# paper (even without pre-curling) can be held for times as long as 48 hours. Thicker papers and those with a high moisture content are more problematic. Thus, by pre-curling the sheet and use of a heated drum, electrostatic forces can easily hold down paper or transparencies for printing without breakdown.

The power supply required for the charging device is dependent on the device chosen for the job. Generally, contact chargers (roll or brush) require lower voltages than do corotrons. A Trek Cor-a-Trol power supply has been used and works well. This is a very versatile unit that can provide adjustable levels of constant current or constant voltage output with many modes of operation.

It is necessary to remove the charge from the drum prior to loading of a new sheet. This must be done in order to keep the voltages within a reasonable range. Complete neutralization is not required, nor is absolute uniformity. A metal or conductive polymer brush will work well for this. Temperature may be a problem with many conductive polymer materials. Therefore a metal brush is preferred and has been used.

Next, the specific requirements for the drying function of the heated drum 16 will be described. For example purposes, it is assumed that radiant internal heating will be provided and insulating walls 28 (as best shown in FIG. 4) will surround the drum to reduce heat loss. Also, an exemplary power consumption of 800 watts for the drying was chosen. To determine power requirements necessary for heating, it is beneficial to treat the power to heat the sheet, the power to heat and evaporate the water from the ink, and the estimated heat loss separately. It is the sum of these that must be equal to or less than the total power constraints (chosen to be 800 watts) as a long-term average.

Figure 7:
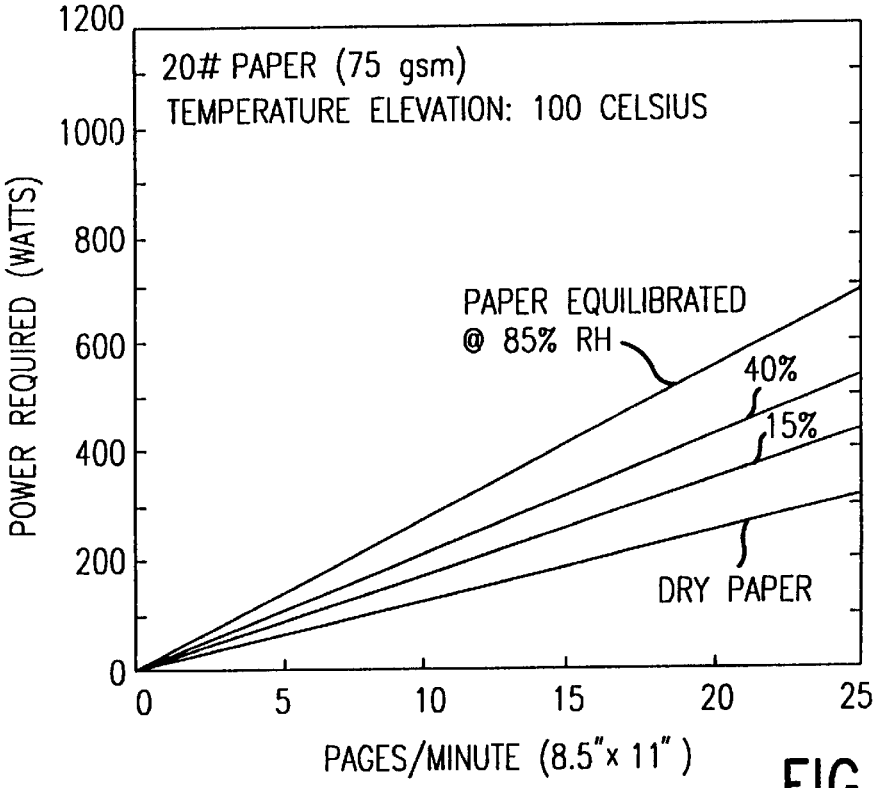
FIG. 7 is a chart of the paper heating power requirements at various RH values.

The heated drum is basically a sheet heater, and heat conduction is relied on through the sheet to drive the evaporation of the ink from the front face of the paper. With low area coverage printing, most of the heat is wasted on heating paper upon which there is no ink to dry. On the other hand, such a heater cannot heat the sheet to a temperature above that of the drum (a safety advantage over external radiant heating), and solid area regions on the print can draw the additional heat required from the drum in order to evaporate the volatiles in the ink. In FIG. 7, the power required to elevate the paper temperature by 100° C. is plotted against the throughput in pages per minute. Note that this plot is for an 8½"×11", 20 pound (75 gsm) paper sheet and that there are 4 lines shown. There is a line for dry paper as well as, respectively, for paper equilibrated at 15% RH, 40% RH, and 85% RH.

Paper sheets stored under high RH conditions acquire moisture as known. As paper with a given moisture content is heated, some of that moisture is driven off after absorbing some of the heat. The paper needs to be heated in order to heat the ink and evaporate the volatiles, and in order to heat the paper sheet there must be enough heat to raise the paper's temperature and drive off the water. When calculating the power required to heat paper with various moisture contents, an effective heat capacity is used for the paper that takes into account the heat required to drive off the moisture. While a dry paper sheet has a heat capacity of 0.4 cal/gm °C., a paper sheet initially at 85% RH which is heated from 22° C. to 122° C. has an effective heat capacity of approximately 0.87 cal/gm-°C. Wet paper is harder to heat and FIG. 7 shows that it would take most of the allocated 800 watt power budget to heat 25 (8½"×11") pages of 20 pound paper by 100° C. in a minute.

However, the entire power budget cannot be spent on heating the sheets. The power is also needed to heat ink that is printed onto the sheet and to evaporate the water from that ink. The ink is heated in order to raise the vapor pressure (and the rate of vaporization) of the volatile components therein. In order to obtain the required (short) dry times, the ink needs to be heated to/near its boiling temperature.

Figure 8:
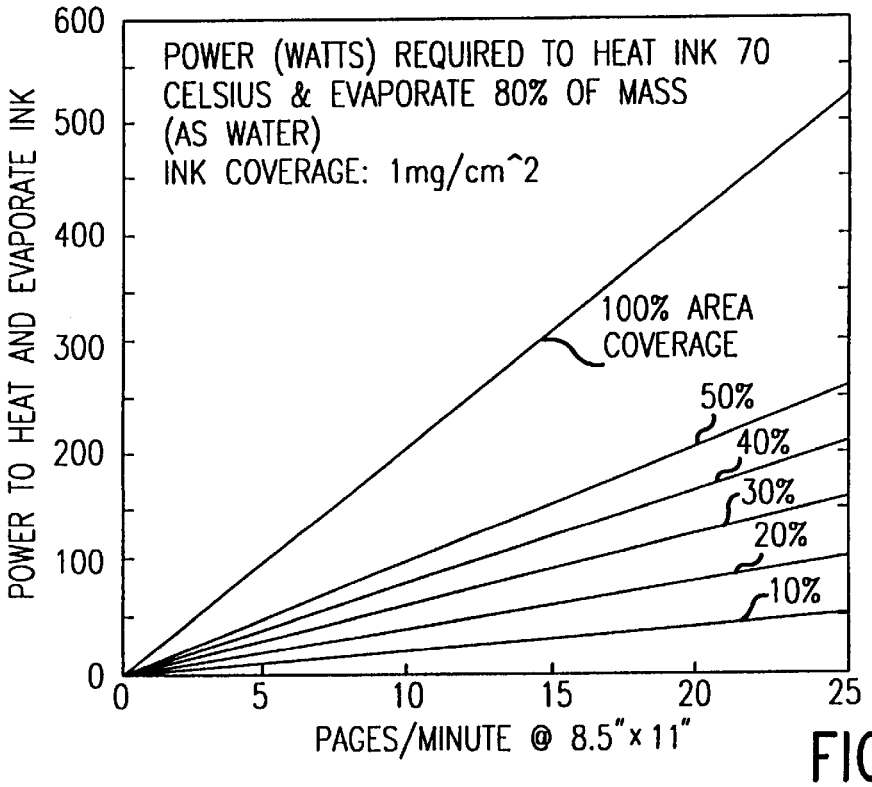
FIG. 8 is a chart of the ink evaporating power requirements for paper having various print area coverage.

From calculations of the heat required to drive the water from the ink on the paper sheet, it is assumed that the ink coverage is 1 mg/cm$^2$ for a solid area. It also is assumed that the liquid ink needs to be heated at least 70° C. in order to reach close to the boiling temperature and that the ink has a heat capacity of 1 cal/gm-°C., like water. We further assume that 80% of the ink mass needs to be evaporated, the water content, and that as water, its heat of vaporization is 540 cal/gm. Having done all that, for 100% area coverage of 8½"×11" at 25 pages/minute, the power required to deal with the ink is 525 watts as shown in FIG. 8. Lesser amounts of area coverage would require proportionally lower powers if we neglect (for the moment at least) the distribution of the heat within the drum.

It is estimated that the heat loss rate from the drum through insulating (oven) walls 28 will be of the order of 75 watts. This will be noticeably higher if insulating walls are not provided around the drum. One would expect this loss rate to be independent of whether the printer is idle or printing. When printing, one can also expect some heat loss from the drum to the air that is pulled through the drum cavity to remove the water vapor that is driven out of the sheet and out of the ink. It is estimated that this loss will be around 50 watts. Another 50 watts of heat loss can be attributed to loss from the drum to the cooled print bar or print element that will be penetrating the insulating walls.

A heat loss due to the air flow through vacuum holes in the drum, if vacuum hold down is utilized, has not been included. This flow can be around, under or through the sheet. The heat lost from the drum due to this air flow will be of the order of 47 watts per cfm of air flow. Accordingly, minimized air flow is essential. The total heat loss for a particular design can be found either analytically or experimentally.

Combining these losses, one can estimate the continuous throughput capability of the heated drum given the 800 watt (or other) power level. We start with the losses which total 175 watts (without that due to air flow through the drum), and if we assume that we are printing on 20 pound paper that is stored at 40% RH, from FIG. 7 we find that 25 pages/minute requires about 520 watts. Adding 520 to 175, we obtain a total of 695 watts. With the remaining 105 watts in the budget, approximately 20% area coverage could be printed continuously (from the chart in FIG. 8).

If we switched to 32# paper sheets in the above environment, no area coverage can be printed at 25 pages/minute. In fact, with the 175 watt known losses, nothing can be printed continuously until the power required to heat the paper drops below 625 watts. This occurs at about 18 pages/minute for a 40% RH. However, if throughput is dropped down to 16 pages/minute, the paperheating power is about 550 watts. When added to the 175 watt losses, there remains 75 watts to heat and dry ink. If the throughput rate is 16 pages/minute and there is 75 watts to spend, printing of around 20% area coverage can be achieved.

From this example, one can easily find comparable heating requirements for different paper sizes and weights. Also, by monitoring the humidity and area coverage with sensors, the appropriate throughput can be automatically selected (through additional turns) or alternatively, power can be increased during peak drying requirement situations to maintain a preset throughput. This last choice would be more appropriate if a rapidly adjustable heating mechanism was utilized such as a microwave heater.

Besides calculating the power requirements of the drying, one must design the system to control and provide required heat for required duration periods. The heated drum (dryer) 16 needs to maintain its temperature over the range of incoming moisture content of the paper sheet and images. For the carriage printing embodiment, the low throughput (and low area coverage on each pass) gives plenty of time to maintain the drum temperature. As such, power limitations occur only with the FWA printbar printing. There are several factors to consider when calculating the energy needs of the dryer. The paper sheet with its moisture needs to be heated up. This requires energy to warm the paper sheet and evaporate the moisture. Thus, the energy needed to print a sheet is dependent on the relative humidity of the environment of the input sheet tray. Table 2 displays the effect of humidity on the maximum area coverage and throughput for 20# paper; heavier paper weights would result in lower throughput capabilities.

TABLE 2

| Relative Humidity (%) or Water Loss | Effective Paper Heat Cap. (cal/gm °C.) | Power to Paper at 25 ppm (watts) | Power With Losses at 25 ppm (watts) | Maximum Area Coverage or Throughput |
|---|---|---|---|---|
| 0 | 0.4 | 326 | 501 | 47% |
| 15 | 0.55 | 448 | 623 | 27.6% |
| 40 | 0.65 | 529 | 704 | 15% |
| 65 | 0.775 | 631 | 806 | 22 ppm @12% |
| 85 | 0.87 | 708 | 883 | 20 ppm @12% |
| 3% water loss | — | 475 | 650 | 23.4% |
| 6% water loss | — | 624 | 799 | 22.5 PPM @12% |

The general strategy is that, when the temperature of the drum falls below a set point (or the duty cycle of the heater exceeds a maximum), additional turns of the drum will be inserted between pages. Thus, even if the humidity is very high and the area cover is high, a few prints may come out at full throughput. With this strategy, a printing controller will not have to sense area coverage or relative humidity—only their effect when combined with the job submissions. However, area coverage sensing could be utilized and thresholds set to start additional drum turns into the cycle.

The preferred method of heating the drum is by a stationary radiant heater 44 (FIGS. 3–4) located in the central region of the drum. By making the heater stationary, the problem of rotating, high power electrical contacts is eliminated. Heat distribution, without external manipulation, is less well directed because it is applied to all portions of the interior of the drum, including those portions that neither need it nor want it. However, such a heater is cost-effective and simple. Reflectors, however, are preferred to further re-direct radiation incident thereto. These reflectors can be utilized inside the drum's end bells 40.

The drum has a large thermal mass, and its temperature responds slowly to heat input or output. Turning the heater off during periods of high density printing will not affect the drying of the sheet being printed. However, if heat is removed non-uniformly from the outer surface of the drum, but added uniformly to the inner surface, spatial temperature variations will develop. The only mechanism available to minimize these temperature variations is lateral heat flow in the drum skin. This can be achieved by coating the inner surface of the drum with an absorbent paint in the regions where the greatest heat flow to the printing media is expected. Any suitable heat absorbing paint will help. Model calculations have shown that circumferential temperature variations due to continuous printing of 11" documents can be significantly reduced by selectively-applied absorptive coatings on the drum.

Alternately, heating elements may be applied to the inside of the drum. These may be evenly spaced around the drum or specifically located within the drum to apply the heat directly to possible printing areas. Such selective heating could provide faster warm up because areas like the end caps can still be cool when printing begins. These heaters could also allow more precise zone control with active or passive controls. However, the slip rings and sensing elements necessary for these heater elements require considerable extra complexity, expense and control.

The mass of the drum is expected to be of the order of 1550 gm, using the preferred size and thickness of aluminum. The heat capacity of aluminum is 0.24 cal/gm-°C., so the heat storage capacity of the drum is 372 cal/°C. The heating rate for the drum is approximately 0.51° C./sec for 800 watts input, taking approximately four minutes for the drum to reach operating temperature from a cold start. The estimated 175 watt losses would cool the drum (with no power in) at a rate of 0.11° C./sec.

If the power to the drum heater were cut off and a sheet of 32# paper equilibrated at 85% RH was loaded, printed at 100% area coverage and stripped, the drum temperature in the region where the action was would sag by only about 4° C. Twenty pound paper at a lower RH would have an even smaller effect.

Most of the power required by the drum is used to heat the paper. Continuous running with heavy, high moisture content papers will result in drum temperature reductions even with 800 watts input. The printer's controller will need to respond to the drum temperature by adding extra drying time if the temperature is too low. The extra time enables the slower process. It also gives the drum heater some time to catch up with the heat demand. Color prints included in the job mix would give the drum plenty of time to recover and stabilize its temperature.

The preferred radiant heater in the drum is cantilever-mounted using a wire-form 46 to support the far end. See FIG. 3B. This allows for lamp replacement, but requires that one drum bearing/support mechanism is hollow and necessitates a large bearing 42.

If temperature regulation of the heated drum is desired, a sensor 60 must follow the drum temperature. The sensor could rotate with the drum, but this would require a rotating electrical contact carrying a sensitive signal. The sensor (60') could contact the drum and follow its temperature, but response time and durability would be limiting factors. Preferably, such a sensor would provide a signal proportional to the mean temperature of the drum. Preferably, the sensor 60 would be mounted near one end of the drum to prevent contact with the maintenance gutter of the drum during rotation.

The sensor could be stationary and mounted to a wiper that rides against the drum inner wall. A tested sensor was embedded in a hole bored into the end of the drum wall with slip rings carrying the signal out.

The end bells 40 of the drum need to support and drive the drum and maintain good concentricity. They need to be made of a material that is capable of withstanding the drum temperatures (and more), but it is expected that the reflectors inside will prevent direct radiation by the lamp. The thermal conductivity of the end bell material should be low in order to prevent excessive heat flow from the drum toward the bearings.

Insulating walls 28 should preferably form an enclosure that surrounds as much of the drum as possible—but not the moving carriage. This will minimize unnecessary heat loss. The sheet entrance and exit paths are preferably blocked when not actually in use. The carriage print heads shoot through restricted openings that might be closed when the printer is idle. The printbar opening is preferably closed off when not being used.

With no attempt to insulate the drum from the ambient (other than phenolic supports for the mounting shafts in order to reduce heat conduction losses), the power lost to the ambient at a temperature of 135° C. was 180 watts. Accordingly, the use of heat shields around the drum is preferred to minimize the heat losses.

The sheet contains much water that will be vaporized on the drum. The ink, of course, will add to this. At 12% area coverage and 25 pages per minute, the ink provides 1.44 grams per minute and the paper can provide three times as much. Estimates have been done to predict how much air flow will be needed to dilute this water vapor to the point that it will not condense inside the printer. These estimates vary, but they conclude that a significant amount of power is lost to the cooling effect of the air.

The drum is heated and it expands. The inventive printer spaces the print heads from the drum at a fixed distance based on the size of the drum when it is hot. The amount of compensation is about 0.006 inches on the radius. This is small compared to the throw distance of about 0.035 inches and it should not vary much. Additionally, the bearing design needs to allow for the lengthwise expansion of the drum.

A motor will drive the drum through a speed reducing belt and pulley system (not shown). The speed reduction is necessary to generate the necessary power with a small motor. A 1024-tick encoder 50 is direct driven from the drum. The drum turns at only 78.11 rpm and 9216 encoder ticks are needed per revolution—one per pixel around the circumference. The pixel clock frequency is obtained by a phase-locked loop multiplication (by 9) of the encoder pulses.

The demands on a motor for this application are slight, although the motor will need to drive the precurler as well as the drum. Many choices abound with cost being the likely discriminating factor. However, service life could be a factor with continuous operation at high speeds. A 7.5 degree stepper motor is the current choice.

The drive ratio for the printing fixture drum is 24:130 for motor:drum. A timing belt is used to transmit the torque, and it is expected that the large moment of inertia of the drum will dampen tooth-frequency oscillations. In any case, with the encoder on the drum, printing is performed on drum location markers.

The most popular source of shaft encoders 50 in this class is Hewlett-Packard. They make rotary encoders in several styles at 1024 ticks/revolution. Additionally, some of these have index pulses as well. An index pulse will be needed in order to synchronize the drum with the paper handling and printing. The drum has a maintenance location that breaks up the rotational symmetry. It is contemplated that use of a large diameter code wheel will reduce the sensitivity as much as possible. Further, two diametrically-opposed sensors can be used on the code wheel in an attempt to remove some of the concentricity errors. There are many choices here with cost not features being the deciding factor.

The gutter 52 is preferably a strip along the surface of the drum that is filled with an absorbent material into which droplets may be fired by the bar and/or print elements. Since this gutter is part of the drum, it will be heated to 135° Celsius or thereabouts. Ink droplets fired into the gutter will dry as on the sheet, and only the non-volatile residues will remain. The gutter can be replaceable.

Because the liquids will quickly evaporate from the ink droplets fired into the gutter, it is not expected that the ink residue will end up far from where the droplets hit. If a smooth surface is provided for the droplets to hit, build up of an ink residue will soon form that may fall off. Thus, a porous or fibrous surface into which the droplets can be fired is preferred. It is expected that such an absorbent porous or fibrous gutter liner will be customer replaceable.

Loading is accomplished by taking the sheet from the pre-curler and ironing it down onto the surface of the drum at the same time as charge is applied. Stripping will be performed by actuating stripper fingers 58 which lift the lead edge of the paper and guide it off the drum.

The invention has been described with reference to the preferred embodiments thereof, which are illustrative and not limiting. Various changes may be made without departing from the spirit and scope of the invention as defined in the appended claims.

What is claimed is:

1. A high-speed inkjet printer comprising:

a sheet input tray for storing a sheet prior to printing, the sheet having a predetermined length;

a sheet output tray for storing printed sheets;

a heated rotary printing drum provided downstream from said sheet input tray;

a sheet input path located between said sheet input tray and said heated rotary printing drum for transporting the sheet from said sheet input tray to said heated rotary printing drum, said heated rotary printing drum acquiring and precisely registering the sheet from said sheet input path such that the sheet is in contact with an outer surface of said heated rotary printing drum, a circumferential length of said heated rotary printing drum being greater than the length of the sheet;

at least one ink jet printhead located for printing an image onto the sheet while the sheet is registered on said heated rotary printing drum; and an exit sheet path located downstream of the heated rotary printing drum for receiving the sheet from the heated rotary printing drum and transporting the sheet from said heated rotary printing drum to said sheet output tray, wherein said heated rotary printing drum is rotated a plurality of complete revolutions to transport the sheet a plurality of times past said at least one ink jet printhead for printing the image onto the sheet, said heated rotary printing drum being provided with a heat source that transfers heat energy to the sheet acquired on said heated rotary printing drum as the sheet is rotated past said printhead, at least one complete revolution of said heated rotary printing drum being provided after printings thereby sufficiently drying the sheet and ink printed on the sheet prior to transfer of said sheet from said drum to said exit sheet path.

2. The printer of claim 1, wherein the sheet is precisely registered by electrostatic forces generated by a charge generator.

3. The printer of claim 1, wherein the sheet is precisely registered by a vacuum force applied by a vacuum source communicating with the outer surface of said heated rotary printing drum.

4. The printer of claim 1, wherein said drum is capable of acquiring sheets selected from the group consisting of 8½"×11", 8½"×14" and A4 sizes.

5. The printer of claim 1, wherein said heated rotary printing drum rotates at a constant speed.

6. The printer of claim 1, wherein said heated rotary printing drum is heated by an internal radiant heater.

7. The printer of claim 6, wherein said heated rotary printing drum is heated by a lamp.

8. The printer of claim 7, wherein said lamp is located stationary within said heated rotary printing drum.

9. The printer of claim 6, wherein said heated rotary printing drum includes an inner surface containing reflective elements for redirecting heat from said radiant heater.

10. The printer of claim 6, wherein absorptive paint is included on at least a portion of an inner surface of said heated rotary printing drum.

11. The printer of claim 1, wherein said heated rotary printing drum comprises a metal core and a thin, insulating outer surface layer.

12. The printer of claim 11, wherein said thin, insulating outer surface layer is a polyimide.

13. The printer of claim 1, wherein said at least one printhead includes a full width printbar for monochrome printing.

14. The printer of claim 13, further comprising at least one additional full width printbar of a differing color.

15. The printer of claim 1, wherein said at least one printhead is selected from a group consisting of:

a single die printhead; a cluster of single die printheads; a partial width array; and a partial width array cluster.

16. The printer of claim 1, wherein said heated rotary drum includes an axially extending ink receiving gutter inwardly recessed from a periphery of the drum.

17. The printer of claim 16, wherein said gutter houses a porous liner.

18. A method of ink jet printing on an ink jet printing system including a heated rotary printing drum, at least one ink jet printhead and a sheet output path, comprising the steps of:

acquiring a sheet onto the heated rotary printing drum;

rotating the heated rotary printing drum a plurality of complete turns to transport the sheet past the at least one ink jet printhead a plurality of times, said drum transferring heat to said sheet to dry the sheet and ink contained thereon during printing by said at least one printhead, said step of rotating including at least one complete revolution of said heated rotary printing drum after said printing by said at least one printhead is completed and prior to removal of the sheet from said heated rotary printing drum to provide additional drying time; and transferring the sheet from the heated rotary printing drum to the sheet output path after the ink is sufficiently dried.

19. The method of claim 18, wherein said step of rotating the heated rotary printing drum is performed at a constant speed.

20. The method of claim 18, further comprising the step of rotating the heated rotary printing drum one or more complete turns after the sheet is acquired and prior to printing to pre-heat the sheet.

21. The method of claim 18, wherein the at least one ink jet printhead is a full width printbar and the step of rotating rotates printing said heated rotary drum two or more complete turns past the printbar and a partial tone of an image is printed by the printbar on each turn.

22. The method of claim 18, wherein the step of rotating the heated rotary printing drum is controlled by a sensor based on heating constraints.

23. The method of claim 18, wherein if time necessary to complete the printing is not sufficient to dry the sheet, the step of rotating the heated rotary printing drum includes additional non-printing rotations of the heated drum to complete drying prior to the step 4 transferring the sheet from the drum.

24. The method of claim 18, wherein the printing system includes an incrementing printhead and the sheet has a leading edge and a trailing edge, the printhead being stationary during the step of rotating the heated rotary printing drum while printing between the leading edge and the trailing edge of the sheet, the printhead incrementing laterally during a partial rotation of the heated rotary drum after passage of the trailing edge past the printhead and before passage of the leading edge of the sheet on a next turn of the heated rotary drum past the printhead.

25. The method of claim 18, further comprising the step of heating the heated rotary printing drum by internal radiant heat.

26. The method of claim 18, further comprising the step of redirecting heat energy from the heated rotary printing drum to the acquired sheet by reflective surfaces within the heated rotary printing drum.

27. The method of claim 18, further comprising the step of performing a maintenance operation in which ink from said at least one printhead is received in a gutter, axially oriented and inwardly recessed from an outer surface of the drum.

* * * * *